US005809762A

United States Patent [19]

Göhler

[11] Patent Number: 5,809,762

[45] Date of Patent: Sep. 22, 1998

[54] DRAW FRAME WITH ADJUSTMENT DEVICE FOR THE DRAFTING ROLLERS

[75] Inventor: Wolfgang Göhler, Lenting, Germany

[73] Assignee: Rieter Ingolstadt Spinnereimaschinenbau AG, Ingolstadt, Germany

[21] Appl. No.: 693,646

[22] Filed: Aug. 9, 1996

[30] Foreign Application Priority Data

Aug. 12, 1995 [DE] Germany ..... 195 29 831.4

[51] Int. Cl.[6] ..... D01H 5/28

[52] U.S. Cl. ..... 57/315; 19/260; 19/261; 19/294

[58] Field of Search ..... 57/315; 19/266, 19/271, 273, 278, 294, 261, 260

[56] References Cited

U.S. PATENT DOCUMENTS

| | | | |
|---|---|---|---|
| 840,779 | 1/1907 | Libby | 19/294 |
| 888,102 | 5/1908 | Libby | 19/294 |
| 1,130,880 | 3/1915 | Blackwood | 19/294 |
| 2,446,021 | 7/1948 | Noguera | 19/294 |
| 2,597,278 | 5/1952 | Arundale et al. | 19/261 |
| 2,707,309 | 5/1955 | Wilson | 19/261 |
| 2,885,740 | 5/1959 | Thompson et al. | 19/294 |
| 2,890,495 | 6/1959 | Meisch et al. | 19/261 |
| 2,922,198 | 1/1960 | Barrett | 19/261 |
| 3,401,430 | 9/1968 | Whitehurst | 19/294 |
| 4,512,061 | 4/1985 | Hartmannsgruber et al. . | |
| 4,525,897 | 7/1985 | Schulz et al. . | |
| 4,593,438 | 6/1986 | Barauke | 19/261 |
| 4,641,397 | 2/1987 | Mondini et al. | 19/258 |
| 5,022,123 | 6/1991 | Ueda et al. | 19/261 X |
| 5,303,454 | 4/1994 | Stahlecker et al. | 19/261 |

FOREIGN PATENT DOCUMENTS

| | | | |
|---|---|---|---|
| 0640703A1 | 8/1994 | European Pat. Off. . | |
| 1009769 | 6/1952 | France | 19/261 |
| 1186574 | 8/1959 | France | 19/261 |
| 21165 | 2/1954 | Germany | 19/294 |
| 1821627 | 5/1960 | Germany . | |
| 2852692A1 | 6/1980 | Germany . | |
| 3532555 | 3/1987 | Germany | 19/261 |
| 183586 | 12/1956 | Netherlands | 19/294 |
| 246959 | 11/1947 | Switzerland . | |
| 401773 | 5/1966 | Switzerland | 19/261 |
| 822352 | 10/1959 | United Kingdom . | |

*Primary Examiner*—William Stryjewski
*Attorney, Agent, or Firm*—Dority & Manning

[57] ABSTRACT

A spinning plant machine has a basic drafting equipment body to receive drafting equipment which has at least two pairs of rollers, whereby each pair is constituted by an upper roller and a lower roller. A device for the adjustment of the distance between the pairs of rollers is in the form of a push rod which is coupled to the bearing arrangement of the lower rollers as well as to fix the support of the lower rollers on the basic drafting equipment body. The push rods can be adjusted with precise parallelism and position.

17 Claims, 4 Drawing Sheets

DRAW FRAME WITH ADJUSTMENT DEVICE FOR THE DRAFTING ROLLERS

BACKGROUND OF THE INVENTION

The present invention relates to a spinning plant machine with drafting equipment for the coupling and drafting of fiber slivers. In these spinning plant machines, e.g. spinning machines, combing machines or draw frames, the distances between the drafting rollers must be adjusted so that different fiber materials may be processed optimally on the same machine. To adjust the bearing blocks in which at least the lower roller of a pair of rollers is supported, DE 33 01 239 A1 discloses that in the drafting equipment of a draw frame the bearing blocks can be shifted following loosening of their attachments. For this, either one of the two bearing blocks which are part of the drafting equipment rollers must be detached separately from the guide rail and must then be displaced parallel and together with the second bearing block of the roller. The bearing blocks must then be aligned very exactly again before being secured. The greatest disadvantage here is the fact that the rollers must be newly adjusted each time. In addition to this, the locking screw by means of which the bearing blocks are held on the guide rail are accessible only from below. All of this renders the adjustment of the distances of the drafting rollers complicated and time-consuming.

DE 29 41 612 C2 discloses a method by which the drafting equipment rollers in a draw frame are placed on a sled which is moved in a straight line, whereby a toothed rod is attached to each sled and meshes with a pinion gear driven by an electrical motor. This arrangement is not only expensive because of its adjusting drive, but the parallel movement of the sleds requires an expensive configuration of their gliding surfaces.

The German utility model 1 821 627 discloses a method in drafting equipment for a twisting or spinning machine by which the bearing blocks of the drafting equipment rollers are provided with a threaded bore interacting with an adjusting spindle. By rotating the adjusting spindle, this bearing block can be adjusted. However this has the disadvantage that the replacement of the bearing blocks is rendered more difficult because the spindle must be unscrewed from the bearing block.

OBJECTS AND SUMMARY OF THE INVENTION

It is a principal object of the present invention to design a spinning plant machine with a drafting equipment having an adjusting device for the drafting rollers such that the disadvantages of the state of the art can be avoided. The adjusting device or the spinning plant machine is low cost and the adjustment of the distances between the drafting rollers can be carried out easily and rapidly. Additional objects and advantages of the invention will be set forth in part in the following description, or may be obvious from the description, or may be learned through practice of the invention.

The objects are attained by the present invention. By using a push rod which also serves as a guide for the bearing as a means to adjust the support, the drafting equipment rollers are easily adjustable within the drafting equipment and the entire drafting equipment is nevertheless simple in its construction. Due to the fact that the means for the adjustment of the bearing, i.e. the push rod, assumes at the same time the guiding function for the support, the drafting rollers become easily adjustable and the entire drafting equipment is nevertheless simple in its design. As a result of this, the reception or guidance for support can be made especially simple on the basic body of the drafting equipment. Furthermore, no measures are needed to prevent jamming of the support during adjustment. Long guidance surfaces through which jamming is reliably avoided can be obtained easily thanks to the push rod. This results in an advantage for the support itself, i.e. the fact that the bearing blocks can be made so bearing blocks of the drafting equipment roller seats can be at a right angle to the roller axis and can be short. Small distances from one pair of drafting rollers to the other can thus be advantageously realized.

It is especially advantageous if the support of the lower roller is made in two parts, so that the two ends of the lower roller are held by their sliding or roller bearings by a separate bearing arrangement. This has the advantage that each end of the roller can be adjusted by its own push rod, so that the adjustment is especially precise and the lower rollers are certain to be parallel to each other. It is especially advantageous for the push rod to be guided via stops at a right angle to its direction of movement. As a result, the precise positioning of the drafting equipment rollers is ensured even when the bearing arrangement is adjusted. The placement of the stop for the guidance of the push rod, directly at the basic body of the drafting equipment, is advantageous in that case. It is especially advantageous for the stop for the guidance of the push rod to be installed at a bearing of a lower roller. This simplifies manufacturer of the basic drafting equipment body. If the stop for the guidance of the push rod is constituted by another push rod, these can support each other mutually and thereby their stability of form and quality of guidance is mutually improved. In addition, the device becomes simpler in this manner and fewer finishing steps are required. It is especially advantageous to make the stop in such manner that its surface is perpendicular parallel to the axis of the lower rollers so that the guidance is parallel to the direction of movement of the push rod and lateral escape of the push rods is prevented. If a stop is provided in a plane which is parallel with the plane in which the axes of the drafting equipment rollers are installed, the result is that an unwanted movement of the push rods and therefore also of the bearing arrangement at a right angle to this plane is prevented. It is especially advantageous here to provide the stop on a bearing for a lower roller, whereby the bearing of the output roller of the drafting equipment is advantageously used for this, since it is not movable and attached to the basic body of the drafting equipment. As a result the guidance does not change its position relative to the basic body of the drafting equipment, so that a guidance of the push rod remaining in the same position can be obtained in a simple manner.

For simple operation of the drafting equipment, and thereby also of the spinning plant machine, in particular for the replacement of the lower rollers, it is especially advantageous if the bearing arrangement is connected in a detachable manner to the push rod which moves it. To replace the bearing arrangement, the latter is simply detached from the push rod which moves it and is taken out of the machine. It is equally simple to install a new bearing arrangement. In order to be able to position the bearing arrangement with precision when it is again installed, it is especially advantageous for the push rod to be provided with a receiving device which receives the bearing arrangement on the push rod exactly as before, i.e. that the newly mounted bearing arrangement is again in precisely the same position. This ensures that the axes of the drafting equipment are parallel and that the distance between the pairs of drafting rollers always remains the same. It is advantageous to provide a clamping device which clamps the push rod in a fixed position relative to the basic body of the drafting equipment. In this manner, the drafting equipment rollers are securely held in one and the same position during operation. Furthermore, in this way, the bearing arrangement itself need not be attached to the basic body of the drafting equipment. This makes it possible to detach and shift the drafting equipment rollers rapidly, since all movable bearing arrangements are fixed at only one or two clamping points. At the same time, the clamping device can also advantageously incorporate stops for guidance of a push rod, and if several push rods are used, all can be guided by the clamping device holding them.

To adjust the drafting equipment rollers easily, it is advantageous for the basic body of the drafting equipment to be provided with a gliding surface on which the bearing arrangement to be adjusted can be shifted. The adjustment of the bearing arrangement, and thereby of the distances between the drafting equipment rollers, is thereby made possible with little force expenditure. The gliding surface is advantageously made so as to be pressure-stable, so that it is able to accept the pressure forces exerted by the upper roller on the lower roller. These forces then need not be borne by the push rods. Their guidance task only consists in maintaining the bearing arrangement at the exact place on the gliding surface.

The movement of the push rod is caused very simply by connecting it via a coupling element to a threaded spindle. Rotation at the spindle makes an especially finely tuned, axial movement of the push rod possible. The axial length of the push rod reaches advantageously from the coupling element over the bearing arrangement to be adjusted up to a guidance following it in the axial direction. Guiding the push rod becomes especially simple and advantageous. If two push rods are used to adjust the bearing arrangement of a lower roller, it is especially advantageous for them to be coupled together so that both push rods can only be moved together in the same direction. In this manner the parallelism of the axes of the lower roller and of the other drafting equipment roller pairs is always preserved, also when adjustments are made. For this, the two push rods are advantageously connected via a coupling each to a threaded spindle and the latter in turn to each other via a chain or belt wheel with appertaining driving belt. It is especially advantageous if this is done by means of a toothed belt which interacts with corresponding belt wheels at the threaded spindles.

The invention is explained below through drawings.

DETAILED DESCRIPTION OF THE PREFERRED EMBODIMENTS

Figure 1:
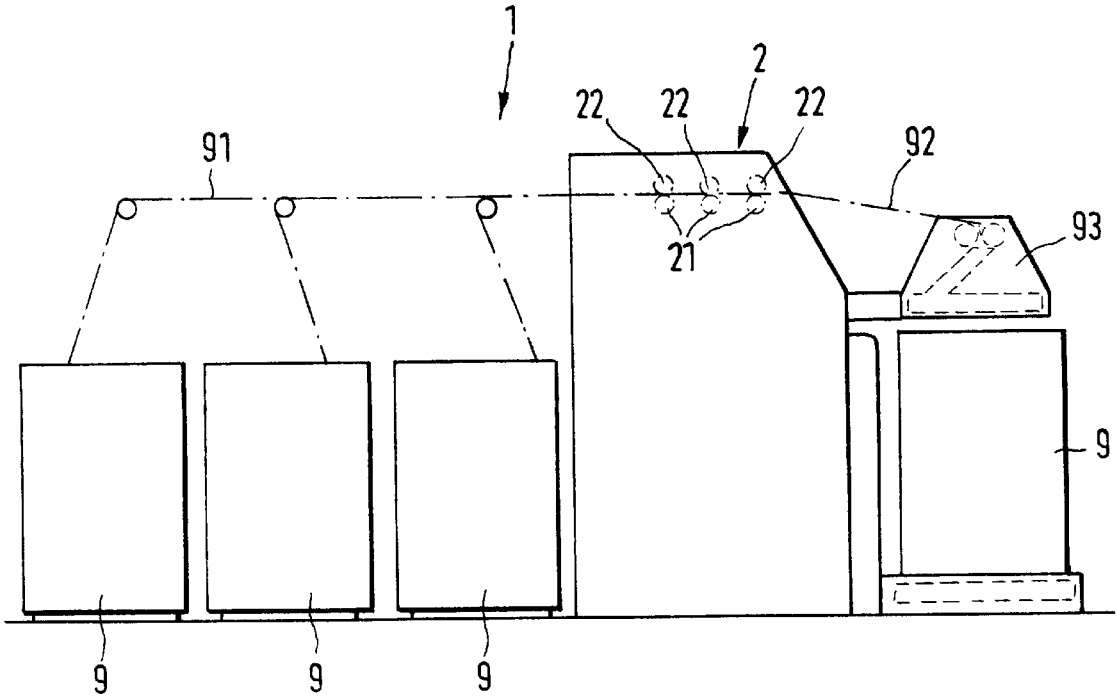
FIG. 1 shows a spinning plant machine, e.g. a draw frame, in a side view.

Reference will now be made in detail to one or more presently preferred embodiments of the invention, one or more examples of which are illustrated in the drawings. Each example is provided by way of explanation of the invention, and not meant as a limitation of the invention. In fact, it will be apparent to those skilled in the art that various modifications and variations can be made in the invention without departing from the scope and spirit of the invention. For example, features illustrated or described as part of one embodiment can be used on another embodiment to yield still a further embodiment.

FIG. 1 schematically shows a draw frame 1 in a side view. A fiber sliver 91 is taken out of several presentation cans 9 and is conveyed to the drafting equipment 2 of the draw frame. The drafting equipment 2 is shown by a point-dotted line. The individual fiber slivers are drafted together in the draw frame and leave the draw frame in the form of a newly drafted fiber sliver 92. Following this it is deposited by means of a rotating depositing plate 93 in a can 9. The drafting equipment 2 of the draw frame 1 may be an autolevelled or a non-autolevelled draw frame. The drafting equipment 2 of draw frame 1 consists of three roller pairs, each consisting of a lower roller 21 and an upper roller 22. However, the number of roller pairs can very well be more than three, and similarly several upper rollers can be attributed to one lower roller.

Figure 2:
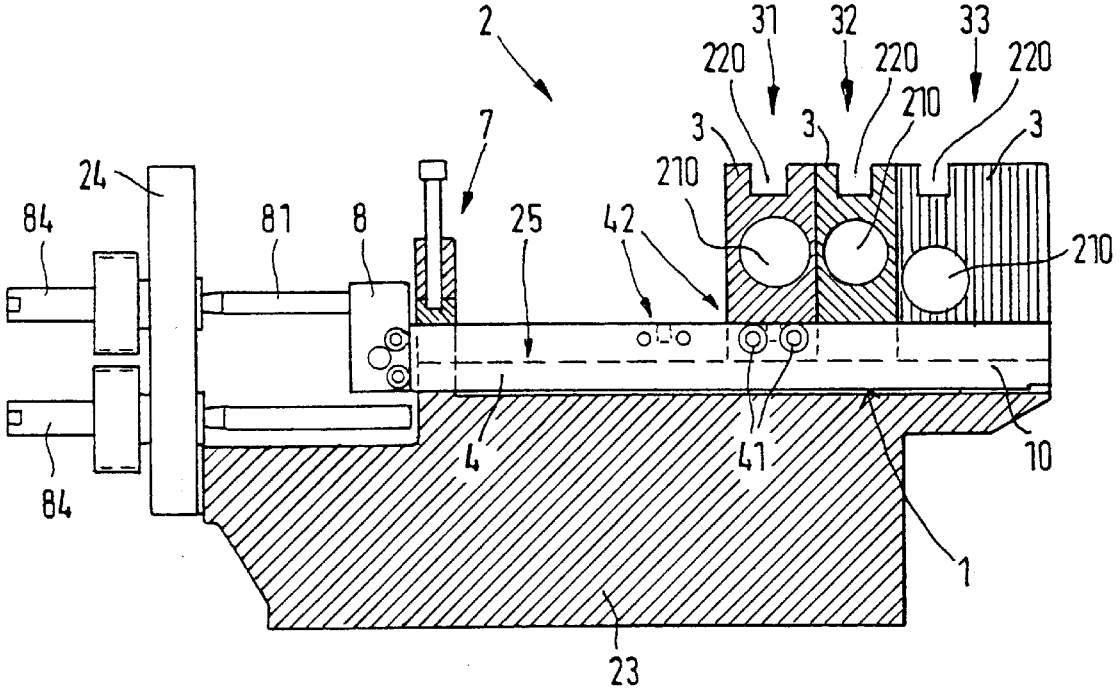
FIG. 2 shows a side view of a draw-frame, partially in a section.

FIG. 2 shows the side view of a drafting equipment 2 for three pairs of drafting rollers pairs which are contained in a basic drafting equipment body 23. The drafting roller pairs, consisting of one upper roller 22 and one lower roller 21 (see FIG. 1) are seated at their ends in bearings 3. Upper and lower rollers are not shown in FIG. 2. Only a bore 210 which receives the bearing of the appertaining lower roller in the bearing arrangements 3 is visible, as well as grooves 220 in which the upper rollers are supported. The upper rollers may remain in the bearing arrangements after opening of the pressure arms (not shown) of the draw frame, or may swivel together with the pressure arm during opening. In the latter case, the upper rollers are detached from the pressure arm once the bearing arrangements have been adjusted, so that they are able to adapt to the bearing arrangement as the pressure arms close. Thereupon they are again attached to the pressure arm. The upper rollers are aligned precisely with the lower rollers by means of grooves 220. Since the fiber sliver enters the draw frame from the left, the left bearing arrangement 3 is the one of the input cylinder of the draw frame, the central bearing arrangement 3 the one of the central cylinder and the right-side bearing arrangement 3 the one of the output cylinder of the drafting equipment 2. The bearing arrangements 3 rest upon the basic drafting equipment body 23 as shown by broken line 10 in FIG. 2. The side of the basic drafting equipment body 23 towards the viewer is shown in a section in order to show the push rod 4. The bearing arrangement 3 of the input cylinder is attached to the push rod 4 by means of two screws 41. By loosening these screws, the bearing arrangement 3 can be taken out of the draw frame. The bearing arrangement 3 is merely held on the push rod 4 and its movement downward in direction of the basic drafting equipment body 23 is limited through the fact that the bearing 3 rests here on the basic drafting equipment body 23. On its side away from the output cylinder, the push rod 4 is provided with a coupling element 8 to which it is screwed. The coupling element 8 has a bore with a thread through which it interacts with a threaded spindle 81. The threaded spindle 81 is mounted in a holding device 24 of the basic drafting equipment body 23 and cannot be displaced axially. Through rotation at the threaded spindle 81, and due to the translation of the rotational movement into a longitudinal movement by the coupling element 8, the bearing arrangement 3 of the input cylinder can be pulled in the direction of the threaded spindle 81. At the same time the bearing arrangement 3 glides in plane 10 on the gliding surface 25 of the basic drafting equipment body 23.

The push rod 4 is provided with a seat 42 which is here made in the form of bores. The seat could however also be made in the form of journals. The corresponding part is in the bearing arrangement 3. When a bearing arrangement is removed from the push rod and then reinstalled on it, the seat 42 makes it possible to mount the bearing arrangement at exactly the same location again, e.g. by screwing it on. Adjustments after changing a bearing arrangement are not necessary. To fix the bearing arrangement within the drafting equipment, a clamping device 7 is provided which uses a locking screw 71 to fix the push rod 4 for the adjustment of the input cylinder as well as (not visible) the push rod for the adjustment of the central cylinder on the basic drafting equipment body 23. As a result, accidental displacement or changing of the distances between the drafting rollers during operation is impossible. The clamping device is the only device, with the exception of the self-inhibiting function of the threaded spindle 81, to fix the bearing arrangement 3 within the drafting equipment. The bearing arrangements themselves are not attached to the basic drafting equipment body 23. They are only attached to the push rod 4 via screw 41. The push rod 4 is moved in the area of the clamping device 7 and in the area of the bearing arrangement of the output cylinder 33. In addition the push rod 4 is moved in the area of the central cylinder 32 by its bearing arrangement 3.

Figure 3:
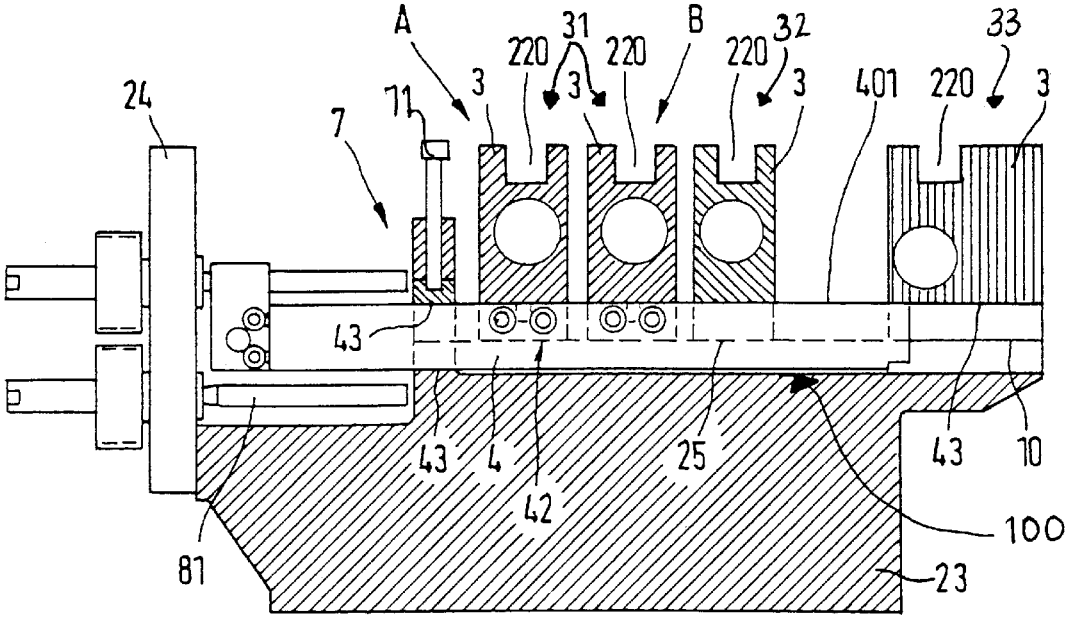
FIG. 3 shows the draw frame of FIG. 1 with adjusted input cylinders and central cylinders.

FIG. 3 shows the drafting equipment 2 of FIG. 2, whereby the bearing arrangement 3 of the input cylinder 31 is shown in its two possible adjustment position. Here the push rod 4 is moved into the position closest to the holding device 24. Positions A of the input cylinder 31 (not visible) is reached when its bearing arrangement is mounted on the left one of the two seats 42 (see FIGS. 2 and 3). Position B is reached when the bearing arrangement of the input cylinder 31 is mounted on the right one of the two seats 42 (see FIGS. 2 and 3). As a rule only one seat 42 is available on its assigned push rod for the central cylinder 32 which is also shown in its position closest to the holding device 24. The output cylinder 33 cannot be displaced within the draw frame. The push rod which adjusts the central cylinder 32 cannot be seen in the drawing of FIG. 3, since it is the same as the shown push rod 4 of the input cylinder 31. The appertaining coupling element is not shown and would be in contact with the lower threaded spindle 81.

The guidance of the two push rods 4 on either side takes place at the clamping device 7 as well as at the output cylinder 33. The push rods 4 glide here with their tops along the underside of the output cylinder 33. Downward, in the direction of the basic drafting equipment body 23, the push rods have a clearance between it and themselves. Additional guidance of the push rods 4 is provided at the clamping device, where the push rod is located below a stop 43 on the basic drafting equipment body.

This stop is an even surface which is perpendicular to the plane of the drawing and extends horizontally in the draw frame. The top 401 of the push rod is guided at the clamping device 7 by an adjustable stop 43. This stop can be fixed by means of the locking screw 71 in direction of the basic drafting equipment body 23 so that it can be moved around the push rods. By being attached to their respectively assigned bearing arrangements 3, the push rods also bear indirectly, via the underside of the bearing arrangement 3, upon the gliding surface 25 of the basic drafting equipment body 23. The push rod lies directly on the basic drafting equipment body 23 only at the clamping device 7 such that a space 100 is defined between the body 23 and the bottom of the push rods. The gliding surface 25 is horizontal in this case exactly as in FIG. 2, and is represented by line 10. The support of the push rod 4 for its movement in vertical direction is provided therefore via stops 43, at the clamping device 7 and at the output cylinder 33. At the stops 43 of the clamping device 7, the push rod is supported upward as well as downward. Otherwise the push rod 4 is also guided by the threaded spindles 81 together with the coupling element 8, in particular during the adjusting process. The essential guiding task is however assumed by the stops 43 at the clamping device 7 and at the bearing arrangements of the output cylinders 33, here however only in the upward direction.

Figure 4A:
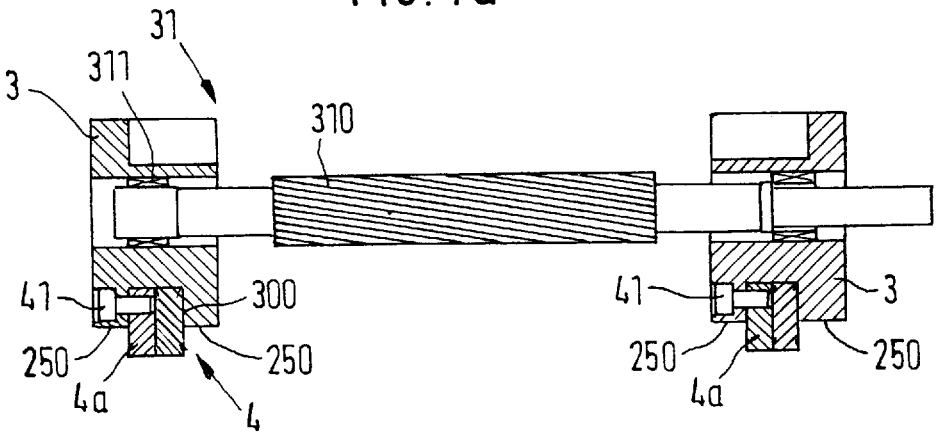
FIGS. 4*a* to 4*c* show the draw frame cylinders with bearing arrangement and push rod as well as parts of the base draw-frame body, in a section.
Figure 4B:
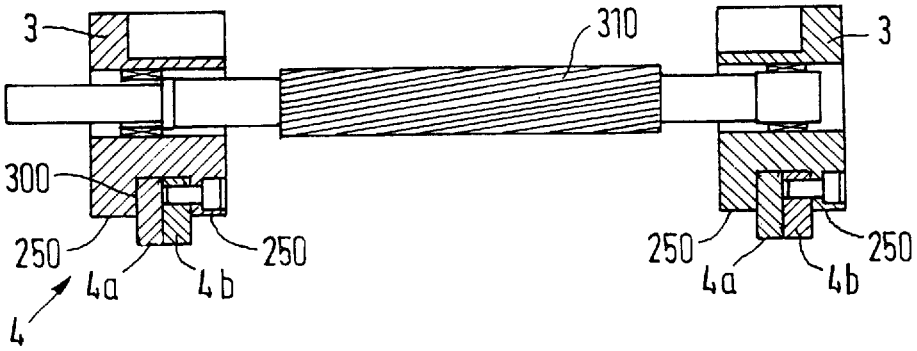
Figure 4C:
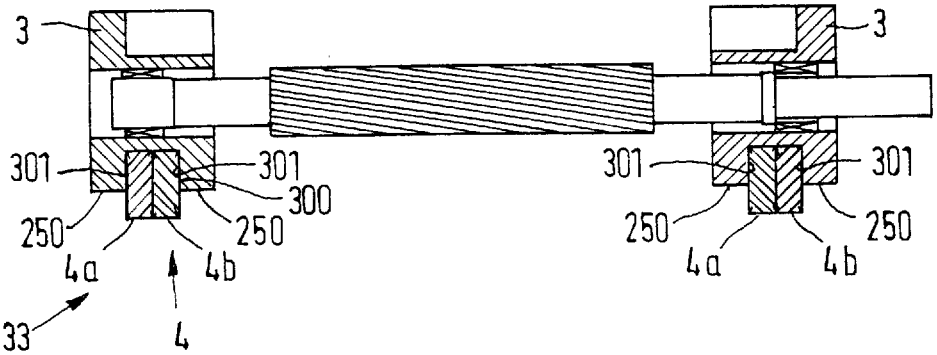

FIGS. 4*a* to 4*c* show a section through the drafting equipment cylinder, in principle as the right-hand side view of FIGS. 2 and 3, whereby input, central and output cylinders are shown one above the other in the drawing for greater clarity. FIG. 4*a* shows the input cylinder 31, FIG. 4*b* the central cylinder 32 and FIG. 4*c* the output cylinder 33. The input cylinder 31 consists of a lower roller 310 which is supported via bearing 311 in the bearing arrangement 3. All three bearing arrangements of FIGS. 4*a* to 4*c* have a recess 300 in which the push rods 4 extend in part. On both sides of the push rods, each bearing arrangement is provided with a supporting surface 250 by means of which they bear upon the gliding surface 25 of the basic drafting equipment body 23. The input cylinder 31 and the central cylinder 32 are here capable of displacement on the gliding surface, while the output cylinder 33 is attached on the basic drafting equipment body by means of fasteners (not shown). The input, central and output cylinders are understood to be the pairs consisting of upper and lower rollers.

The bearing arrangement 3 of the input and central cylinder is made in two parts so that two push rods 4 are also required to adjust the bearing arrangement 3. To adjust the input rollers 31, a push rod 4*a* is provided on the right hand bearing arrangement 3 and a push rod 4*a* on the left hand bearing arrangement 3. The left hand and right hand bearing arrangements 3 of the input cylinder are connected by screws to the appertaining push rods 4*a*.

The lateral guidance at the push rods 4*a* assigned to the input cylinder 31 is effected by the bearing arrangement 3 of central and output cylinder, as well as by the clamping device 7. The push rods 4*a* for the adjustment of the input cylinder 31 are attached to the bearing arrangements 3 of the input cylinder 31 by means of screws 41. In the recess 300 of the bearing arrangement 3 of the central cylinder 32 of FIG. 4*b*, the push rod 4*a* is provided in addition to the push rods 4*b* which adjust the bearing arrangement of the central cylinder 32, and are required to adjust the bearing arrangement 3 of the input cylinder 31 (see also FIG. 4*a*). In the recess 300 of the bearing arrangement 3 of the output cylinder 33 of FIG. 4*c*, the two push rods 4*a* and 4*b* are placed. The push rods 4*a* and 4*b* are guided laterally in such manner that they bear either against one of the two lateral walls 301 or in opposite direction against the other push rod. The push rods are also laterally supported against the lateral walls of the clamping device 7.

Figure 5:
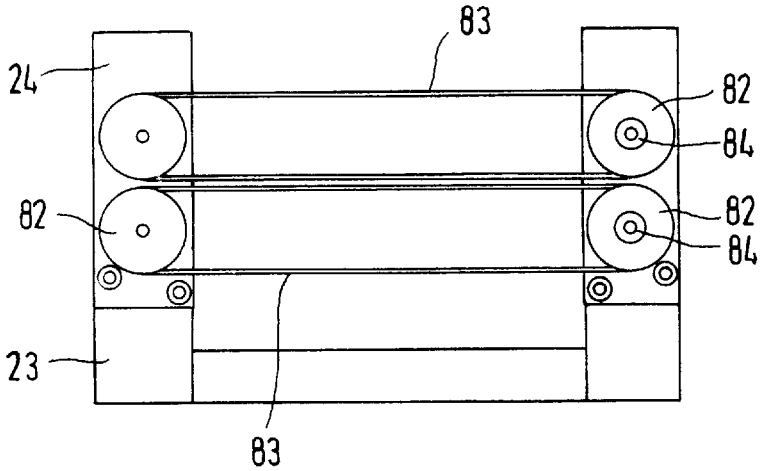
FIG. 5 shows a partially left side view of the draw frame of FIGS. 2 and 3.

FIG. 5 shows a left lateral view of the drafting equipment of FIGS. 2 and 3 with the components visible in this view that are essential for the movement of the push rods for the adjustment of the drafting rollers. On the basic drafting equipment body 23, for the left as well as for the right side, holding devices 24 are provided to receive the threaded spindle 81 (see FIGS. 2, 3). The threaded spindles 81 extend via a bearing arrangement through he holding device 24 and are there connected to a toothed belt wheel 82. Since the drafting rollers are adjusted by two push rods on each side, four threaded spindles are accordingly provided, each with a toothed belt wheel 82. Two toothed belt wheels 82 at a time are connected to each other by means of a toothed belt 83. The toothed belt wheels 82 have a drive rod 84 on which a drive wheel (not shown) can be set, so that the rotation of the threaded spindle can be produced. It is sufficient here if, as in FIG. 5 for example, only the two toothed belt wheels 82 of the right side are equipped with a drive rod 84, since the rotation of a toothed belt wheel 82 on the right side via toothed belt 83 is transmitted to the toothed belt wheel on the left side. The utilization of a toothed belt ensures that the right-hand toothed belt wheel is given the same rotation as the left one, so that the threaded spindles on both sides move over the exactly same path. As is clearly shown in FIGS. 2 and 4, the two upper toothed belt wheels 82 adjust the input cylinder 31 of the drafting equipment and the two lower ones the central cylinder of the drafting equipment. Instead of a manually operated adjusting wheel, it is also possible to install and electrical motor on the drive rod 84 or to connect it via a gearing, so that the adjustment of the drafting rollers can be electrical and possibly also automatic. It is also advantageously possible to operate the clamping device 7 also automatically for adjustment, e.g. by means of a pneumatic or hydraulic clamping device, so that the entire adjusting process can be automated. Due to the fact that the parallelism of the drafting rollers is always ensured as described earlier during adjustment, it is also possible to make an adjustment also during operation, e.g. by means of an automatic adjusting device, whereby the means to influence the upper rollers must be designed accordingly.

It will be apparent to those skilled in the art that various modifications and variations can be made in the present invention without departing from the scope and spirit of the invention. It is intended that the present invention cover such modifications and variations as come within the scope of the appended claims and their equivalents.

I claim:

1. A textile spinning plant machine, comprising:

a body, and a drafting device operably mounted on said body having at least two pairs of rollers each of which includes an upper roller and a lower roller;

displaceable bearing arrangements receiving each end of at least one of said lower rollers for adjusting the distance between said lower rollers on said body;

each said bearing arrangement non-movably coupled to a respective push rod which is non-threadedly conveyed and slidably displaceable along said body in a direction at a right angle to a longitudinal axis of its respective said lower roller;

said bearing arrangement and push rod coupled so that said bearing arrangement bears directly and non-movably against at least one flat lateral wall of said push rod and slides directly along a sliding surface of said body;

said push rod defining at least one non-rotational guide surface for its respective said bearing arrangement; and at least one guide element in sliding non-rotational contact with said push rod guide surface to guide and support said push rod in its direction of movement.

2. The machine as in claim 1, wherein at least one of said guide elements include lateral walls defined in said bearing arrangements.

3. The machine as in claim 1, wherein at least one of said guide elements include surfaces of adjacent said push rods.

4. The machine as in claim 1, wherein at least one of said guide elements includes a stop adjustable relative to said body.

5. The machine as in claim 4, wherein said stop comprises a guiding surface disposed in a plane parallel to a plane in which adjustment of said bearing arrangements takes place.

6. The machine as in claim 4, further comprising a non-displaceable bearing arrangement receiving a lower said roller, said stop defined by a surface of said non-displaceable bearing arrangement.

7. The machine as in claim 6, wherein said non-displaceable bearing arrangement is a bearing arrangement for an output roller of said drafting device.

8. The machine as in claim 1, wherein said push rods are detachably coupled to said bearing arrangements.

9. The machine as in claim 8, wherein said bearing arrangements comprise seats for precise attachment of said push rods.

10. The machine as in claim 1, further comprising a clamping device for fixing said push rods relative to said body.

11. The machine as in claim 10, wherein said clamping device further comprises a stop for guiding at least one said push rod.

12. The machine as in claim 1, wherein said body defines gliding surfaces for said bearing arrangements for adjustment of said bearing arrangements relative to said body.

13. The machine as in claim 12, said gliding surfaces are also guide elements for said push rods for lateral or vertical guidance of said push rods.

14. The machine as in claim 1, further comprising a threaded spindle drive mechanism for axially moving said push rods.

15. The machine as in claim 14, further comprising a coupling element connected between said threaded spindle drive mechanism and said push rods.

16. The machine as in claim 14, wherein said push rods for each of said displaceable bearing arrangements of a said lower roller are coupled to a common drive mechanism for simultaneous adjustment thereof.

17. The machine as in claim 16, wherein each said push rod is coupled to a threaded drive spindle, and further comprising a drive belt mechanism operably connecting said threaded drive spindles so that rotation of one said drive spindle rotates said other drive spindle.

* * * * *